United States Patent [19]

Johnson

[11] 4,089,785

[45] May 16, 1978

[54] COMPOSITION FOR IMPROVING FLAME RETARDANCY PROPERTIES OF TEXTILE FIBERS

[75] Inventor: Gordon Carlton Johnson, Armonk, N.Y.

[73] Assignee: Union Carbide Corporation, New York, N.Y.

[21] Appl. No.: 807,017

[22] Filed: Jun. 16, 1977

Related U.S. Application Data

[62] Division of Ser. No. 668,800, Mar. 19, 1976, Pat. No. 4,054,695.

[51] Int. Cl.[2] ..... C09K 3/28

[52] U.S. Cl. ..... 252/8.1

[58] Field of Search ..... 252/8.1

[56] References Cited

U.S. PATENT DOCUMENTS

| | | | |
|---|---|---|---|
| 2,735,791 | 2/1956 | Peyrot et al. | 427/390 E |
| 3,806,488 | 4/1974 | Stone et al. | 260/45.85 N |
| 3,822,327 | 7/1974 | Weil | 428/921 |

*Primary Examiner*—Leland A. Sebastian
*Attorney, Agent, or Firm*—Francis M. Fazio

[57] ABSTRACT

Silicone textile treating compositions containing as a flammability retarder a chelator, such as ethylenediamine tetraacetic acid or a salt, ether or ester thereof.

8 Claims, No Drawings

COMPOSITION FOR IMPROVING FLAME RETARDANCY PROPERTIES OF TEXTILE FIBERS

This is a divisional application of Ser. No. 668,800, filed Mar. 19, 1976, now U.S. Pat. No. 4,054,695.

BACKGROUND OF THE INVENTION

The use of synthetic fibers has increased immensely within the past several decades. These fibers possess many desirable properties and characteristics and quite often they are further treated to obtain even more desirable properties. A frequent treatment involves the use of a wide variety of silicone treating agents. Depending upon the particular synthetic fiber involved and the particular treating agent selected, one can improve the lubricity, tactile or other chemical or physical properties of the fiber. This knowledge is well known to those skilled in the art and while many such treatments are known, efforts continue to develop even better products. However, in many instances the silicones tend to cause a deterioration in flammability, particularly when the synthetic is a polyester fiber.

SUMMARY OF THE INVENTION

This invention relates to compositions for treating silicone-treated synthetic fibers to improve their flame retardancy properties, the treated fibers themselves and the methods for applying the compositions to produce the treated fibers. The preferred treating compositions comprise blends of a silicone compound and a chelating agent as flame retarder. However, the flame retarder can be applied as a separate treatment to the silicone-treated fiber. While both classes of these materials are well known in the art, it has not heretofore been known that the combination significantly reduces the flammability of certain synthetic thermoplastic fibers. The preferred flame retardant chelating agents are derivatives of ethylenediamine as more fully described hereinafter.

DESCRIPTION OF THE INVENTION

The adverse effect on flammability of silicones on many thermoplastic synthetic fibers is alleviated by the addition of small amounts of certain known chelating agents. The discovery that these chelating agents would be beneficial in reducing flammability caused by the topical treatment of thermoplastic fibers with silicones was a completely unexpected and unobvious finding and to the best of our knowledge, has not heretofore been suggested or disclosed. The manner in which this effect is achieved is not known. However, the results achieved are real and readily recognized.

The silicone-treated synthetic thermoplastic fibers that are treated with the compositions of this invention to retard their flammability include the polyesters, polyamides, polyacrylics, as well as blends thereof with natural fibers or with other synthetic fibers or with each other. In addition, copolymers thereof can also be treated to advantage. While it is believed that the improvement will be observed with most synthetic fibers, the invention finds exceptional utility in its application to the polyester fibers or blends thereof.

The chelating or flame retarding agents found to have a profound effect on retarding the flammability of the synthetic fibers are those represented by the general formula:

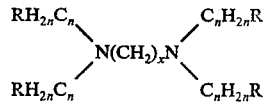

wherein $x$ has a value of from 1 to about 5, preferably 1 to 3, and R is a carboxyl group or hydroxyl group, or the salts, ethers or esters thereof. These compounds are well known and illustrative thereof one can mention ethylenediamine tetraacetic acid, propylenediamine tetraacetic acid, as well as the sodium or potassium or ammonium salts thereof and N,N,N',N'-tetrakis(2-hydroxypropyl)ethylenediamine.

The flame retarding agent is generally used together with the silicone textile treating agent in a common treating bath when it is applied to the fiber. As previously indicated, any of the silicone treating compounds conventionally employed for treating synthetic fibers can be employed in the compositions of this invention. These are so well known that they should not require further detailed description to enable one skilled in the art to understand which compounds are intended. Many publications exist showing a wide variety of silicone compounds as, for example, those disclosed in U.S. Pat. Nos. Re. 25,727, 2,930,809, 3,488,217, 3,511,699, 3,655,420, 3,766,115, 3,772,069 and 2,909,549. The silicone compounds can be homopolymers, copolymers, terpolymers, quadripolymers or modifications thereof which contain alkyl alkyleneoxy groups copolymerized in the molecule such as those compounds disclosed in U.S. Pat. Nos. 2,834,748, 2,917,480 wherein the oxyalkylene segment can be mixed, random or block.

The silicone compounds generally are trimethylsiloxy end terminated though in some instances the terminal group can also contain a hydrogen atom, hydroxyl radical or alkoxy or aryloxy radical on the silicon atom. The silicone molecules also contain repeating units of the structures:

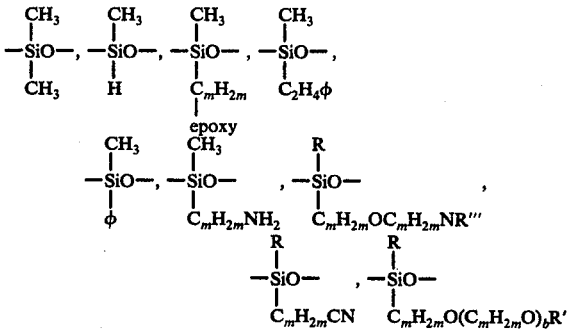

wherein $m$ is known to be a positive integer and can have a value of from 2 to 4; $b$ has a value of from 1 to 75 preferably up to 50; R' is hydrogen or alkyl of from 1 to 4 carbon atoms; and the epoxy group can be on an aliphatic or cycloaliphatic moiety attached to the $C_mH_{2m}$ group via a carbon or an ether oxygen atom. The structures of these repeating units are merely illustrative of several that are known to be useful and present in silicone compounds often employed in the treatment of synthetic organic fibers. Any silicone compound can be blended with the chelators or flame retarders defined above.

The concentration of flame retarder in the treating composition can vary from 1 to 25 weight percent, preferably from 5 to 15 weight percent based on the total weight of silicone compound in the bath or composition. The quantity in a particular bath will vary depending upon the particular fiber to be treated, its effect on the other components in the bath and their effect on it, as well as the amount thereof one wishes to apply to the fiber and the degree of improved flame retardancy desired. It has been observed that a reduction in flammability of the silicone treated fiber is obtained when from 0.002 to 3.75 weight percent of the flame retarder, preferably from 0.1 to 2.25 weight percent, based on the dry weight of the fiber, is deposited on the fiber. Any amount sufficient to retard flammability can be applied to the fiber. Therefore, concentrations above those stated can be used, but from a commercial point of view are not really desirable.

The most convenient method for applying the flame retarder to the silicone treated fiber is to have the flame retarder present in a fiber treating bath. This bath can be in the form of a solution, emulsion or dispersion. The bath can contain in addition to the conventional amount of silicone treating compound and the defined amount of flame retarder, any of the other additives those skilled in the art generally use in preparing compositions of this nature for treating a synthetic thermoplastic fiber. For example, the treating composition can contain other known flame retardants, emulsifiers or surfactants, colorants, antistats, lubricants, durable press resins, water repellants, and the like.

The fiber treating baths are prepared by the conventional procedures known to those skilled in the art and therefore do not require elaborate discussion and explanation herein.

In a typical embodiment a treating bath is prepared containing the silicone textile treating agent, emulsifying agent and flame retarder. In addition, one can also include any other additive normally present in a bath of this nature used to apply a silicone to the surface of a textile fiber. The fibrous material is then passed through the bath or padded with the bath to the desired add-on and dried. Any known method of application can be used.

It has been noted that the use of the flame retarders of this invention in the silicone treating baths have no observable effect on the other properties of the fiber. They do have an effect on the flammability characteristics of the silicone treated fiber and in some instances, depending upon the particular synthetic fibrous material involved, the improvement in flammability retardancy is not as pronounced as it is with other fibers. It was also observed that flammability retardancy was not achieved with the use of several other known conventional chelating agents. For example, it is known that citric acid as well as certain polyethylene glycol compositions are useful as chelators. However, these chelators showed no flame retardancy when added to the silicone treating baths.

In the following examples the fibers were evaluated for flammability by means of the following procedures:

Quick Screen Vertical Flammability Test (QSV)

In this test a small sample of the fibrous material, about 1.5 grams, is formed into a wad, supported on a hook, and an attempt is made to ignite the fibers with a common wood safety match. The ease of ignition, rate of burn and degree of burn are observed and reported.

Quick Screen Horizontal Flammability Test (QSH)

In this test a carded pad of the fibers, roughly 15 by 42 cm and weighing about 13 grams, is ignited with a No. 1588 methenamine pill placed in the center of the pad. The rate of burn and the length of the burn were measured and the test was terminated either when (a) the sample self-extinguished or (b) the sample was consumed by the flame. In addition, the time required for the fiber to burn from a point 5 cm. from the ignition source to a point 25 cm. from the ignition source can be measured and reported as cm./sec. burn rate.

In the above tests the rating of the evaluations were reported according to the following scales:

| Ignition: | Burning: |
|---|---|
| None N | Slight S |
| Difficult D | Partial P |
| Easy E | Complete C |
| | Self-extinguishing SE |

The following examples serve to further illustrate the invention.

EXAMPLE 1

A fiber treating silicone bath was prepared containing 0.4 grams of dimethylpolysiloxane having an average molecular weight of 12,000 in about 200 grams of perchlorethylene and 1 weight percent, based on the weight of the siloxane, of ethylenediamine tetraacetic acid (Bath I).

In a similar manner a second bath was prepared containing 10 weight percent of the ethylenediamine tetraacetic acid (Bath II).

For control purposes a bath was prepared without the addition of the ethylenediamine tetraacetic acid (Bath III).

Samples of polyester fiber were dipped in each of the above baths, removed and squeezed of excess liquid, and air dried. The amount of dimethylpolysiloxane deposited on the fibers was between 0.7 to 1 weight percent. The dried fabric was heated at 160° C. for 5 minutes. The treated fibers were conditioned for a minimum of 16 hours at 50 to 60 percent relative humidity at room temperature. Each of the fiber samples was then tested for flammability by the QSV test; the results are set forth below:

| Bath | Ease of Ignition | Degree of Burn |
|---|---|---|
| I | E | P |
| II | E | SE |
| III | E | C |

As can be seen, the expected result was noted in the absence of the flame retarding chelator; the control fiber treated with Bath III completely burned. The two fibers containing the flame retarding chelators obtained by treatment with Baths I and II showed improved flammability. In fact, when the concentration of the chelator, based on silicone compound present in the bath, was 10 percent, the flame self-extinguished. In this example the textile agents were employed in solution baths.

EXAMPLE 2

A textile treating emulsion composition was prepared containing 2.8 grams of the dimethylpolysiloxane used in Example 1, 0.28 grams of a ⅔ mixture of the non-ionic emulsifiers trimethylnonyl polyethylene glycol ether and nonylphenyl polyethylene glycol ether in 397 grams of water. This bath also contained 10 weight percent of the tetrasodium salt of ethylenediamine tetraacetic acid, based on the weight of the siloxane (Bath I).

A similar treating composition was prepared containing only 1 weight percent of the tetrasodium salt of ethylenediamine tetraacetic acid (Bath II).

For comparative purposes a similar bath was prepared that did not contain any of the tetrasodium salt of ethylenediamine tetraacetic acid (Bath III).

Following the procedure described in Example 1, polyester fibers were treated with these emulsions and the treated fibers were evaluated for flammability. The results are set forth below:

| Bath | Ease of Ignition | Degree of Burn |
|---|---|---|
| I | D | SE |
| II | E | C |
| III | E | C |

It is to be noted that in this particular instance the use of only 1 percent of the tetrasodium salt of ethylenediamine tetraacetic acid failed to improve the flammability properties of the polyester and that good flammability properties were obtained when 10 weight percent thereof is present in the bath. When compared to the results reported in Example 1 it becomes apparent that the concentration of flame retarder to be used will vary depending upon the specific one selected. The minimum concentration to be used to achieve a desired result in any particular instance can readily be determined by a simple laboratory experiment and evaluation by following the procedure of this example.

EXAMPLE 3

A textile treating composition was prepared containing 0.4 gram of the dimethylpolysiloxane used in Example 1, 200 grams of perchlorethylene, and containing 10 weight percent, based on the weight of the siloxane, of the disodium salt of ethylenediamine tetraacetic acid. Following the procedure described in Example 1, polyester fiber was treated with the solution and the treated fiber was evaluated for flammability. Flammability evaluations indicated that the ease of ignition rating was D and the degree of burn rating was P.

EXAMPLE 4

A series of aqueous dispersions of silicone emulsions was made both with and without the addition of the tetrasodium salt of ethylenediamine tetraacetic acid as flammability retarder to determine the effects of the flammability retarder in conjunction with various surfactants.

Each of the formulations was used to treat polyester staple fiber and deposit approximately 1 weight percent of the silicone derivative and 0.1 weight percent of the flammability retarder, both based on the dry weight of the fiber, to the staple. The fibers were air dried, cured for five minutes at 160° C. and then conditioned at 50 to 60 percent relative humidity at room temperature for at least 24 hours. The QSH test was used to determine flammability and the time for the staple to burn from a point 5 cm. to a point 25 cm. from the ignition source was measured and reported as cm./sec. burn rate. The average of 2 evaluations is reported. In some instances, the material self-extinguished and this is indicated by the letters SE. The formulations and flammability results are tabulated in Table I and compared to controls in which the fiber was treated with siloxane without the flame retarder.

TABLE I

| | FORMULATION | | | | | |
|---|---|---|---|---|---|---|
| | Siloxane | | Emulsifier | | $Na_4EDTA$ | QSH Test |
| Run | Type | % Conc. | Type | % Conc. | % Conc. | cm./sec. |
| 1A | I | 0.7 | C | 0.07 | 10 | 0.30 |
| 1B | I | 0.7 | C | 0.07 | 0 | 0.47 |
| 2A | II | 0.7 | C | 0.07 | 10 | 0.16 SE |
| 2B | II | 0.7 | C | 0.07 | 0 | 0.33 |
| 3A | III | 0.7 | C | 0.035 | 10 | 0.23 |
| 3B | III | 0.7 | C | 0.035 | 0 | 0.54 |
| 4A | III | 0.7 | D | 0.0175 | 10 | 0.32 |
| 4B | III | 0.7 | D | 0.0175 | 0 | 0.43 |
| 5A | IV | 0.7 | — | 0 | 10 | 0.12 SE |
| 5B | IV | 0.7 | — | 0 | 0 | 0.27 SE |
| 6A | V | 0.7 | E | 0.07 | 10 | 0.51 |
| 6B | V | 0.7 | E | 0.07 | 0 | 0.57 |
| 7A | VI | 0.7 | E | 0.07 | 10 | 0.13 SE |
| 7B | VI | 0.7 | E | 0.07 | 0 | 0.33 |

I - A 20/80 methyl hydrogen siloxy/dimethylsiloxy polymers blend, the blend having an average molecular weight of about 15,000.
II - Dimethylpolysiloxane having an average molecular weight of about 12,000.
III - An epoxy modified dimethylpolysiloxane having an average of about 500 dimethylsiloxy units andabout 10 methyl epoxy cyclohexylethyl siloxy units in the molecule.
IV - A block copolymer of about 20 weight percent dimethylsiloxy units and about 80 weight percent poly(ethyleneoxy/propyleneoxy) copolymer units.
V - A siloxane having an average of about 80 dimethylsiloxy units and about 40 phenylethyl methyl siloxy units in the molecule.
VI - A siloxane having phenyl methyl siloxy units in the molecule.
C - A 2/3 mixture of trimethyl nonyl polyethylene glycol ether and an alkaryl polyethylene glycol ether.
D - A 2/1 mixture of triethanolamine alkyl aryl sulfonate and the condensate of ethylene oxide, propylene oxide with ethylene glycol.
E - Polyoxyethylene lauryl ether.
$Na_4EDTA$ - Tetrasodium salt of ethylenediamine tetraacetic acid.

As indicated in Table I, a reduction in flammability was observed in all instances in which the flame retarder of this invention is present. It was also noted that in Run 3B, all of the fiber was consumed in the control silicone treated material that was not treated with the flammability retarder. However, in Run 3A, the silicone treated material treated with the flammability retarder, 37 percent of the fiber remained unburned.

EXAMPLE 5

A textile treating composition was prepared containing 0.7 grams of dimethylpolysiloxane having an average molecular weight of 12,000, 0.07 gram of Emulsifier C of Table I in 250 grams of water and 0.007 grams of N,N,N',N'-tetrakis(2-hydroxypropyl)ethylenediamine (Bath I).

A second formulation was prepared in the same manner containing 0.07 gram of N,N,N',N'-tetrakis(2-hydroxypropyl)ethylenediamine (Bath II).

For control purposes, a bath was prepared in the same manner without the addition of the N,N,N',N'-tetrakis-(2-hydroxypropyl)ethylenediamine (Bath III).

Polyester fiber was treated with each of the baths in the manner described in Example 1 and flammability was determined using the QSV test. The polyester fibers treated with Baths I and II were difficult to ignite whereas the polyester fiber treated with Bath III ignited readily. These results show the reduction in flammability achieved by the presence of the flame retarder on the silicone treated fibers.

EXAMPLE 6

A series of silicone aqueous emulsion formulations was prepared containing the components set forth in Table II. These baths were used to treat a polyacrylonitrile fiber by dipping the fiber into the solution, squeezing to remove excess liquid to give a nominal one weight percent siloxane loading, air drying, curing at 160° C. for 5 minutes, and then conditioning for at least 16 hours at 50 to 60 percent relative humidity at room temperature. The treated fibers were evaluated for flammability and it was observed that those fibers treated with the bath containing the ethylenediamine tetraacetic acid were less flammable than those that were treated with the baths that did not contain this flame retarder. The results are tabulated in Table II.

TABLE II

| | FORMULATION | | | | | | QSH |
|---|---|---|---|---|---|---|---|
| | Siloxane | | Emulsifier | | $Na_4EDTA$ | | cm./ |
| Run | Type | % Conc. | Type | % Conc. | % Conc. | QSV | sec. |
| 1A | II | 0.7 | C | 0.07 | 10 | D/C | 0.53 |
| 1B | II | 0.7 | C | 0.07 | 0 | E/C | 0.61 |
| 2A | III | 0.7 | C | 0.07 | 10 | D/C | 0.55 |
| 2B | III | 0.7 | C | 0.07 | 0 | E/C | 0.59 |
| 3A | VII | 0.7 | F | 0.07 | 10 | — | 0.44 |
| 3B | VII | 0.7 | F | 0.07 | 0 | — | 0.74 |

II, III, C - See Table I.
F - A 2/3 mixture of the 3 mole and 12 mole adducts of the mixed $C_{11}$ to $C_{15}$ linear alcohols.
VII - A siloxane having an average of about 180 dimethylsiloxy units and about 10 aminobutyl methyl siloxy units in the molecule.

The results indicate that flame retardancy of polyacrylonitrile is not as dramatic as is achieved with polyesters. However, there is a decrease in flammability by the QSH test and it was noted that ease of ignition was more difficult by the QSV test.

EXAMPLE 7

In this example, a two-step sequence of addition of the flammability retarder and silicone treating agent was compared to that procedure whereby all of the components were initially present in the treating bath and applied in a single step. It was found that there was no noticeable difference in flammability when using a two-step sequential procedure. A disadvantage noted was that fiber handling was somewhat more difficult. However, this can be overcome to some degree by proper engineering design.

In this example, the manner in which the fibers were treated is set forth in the table as are the formulations used. One bath was an aqueous emulsion containing 0.7 weight percent of the dimethylpolysiloxane described in Example 1 and 0.07 weight percent of Surfactant C of Table I. The other bath contained 0.07 weight percent of the flammability retarder only in water. Polyester staple fibers were treated to apply a dry add-on of 1 weight percent of the siloxane and 0.1 weight percent of the flammability retarder, based on the weight of the fiber. The fibers were treated and evaluated as described in Example 1 after the formulations had been applied thereto. The results are set forth in Table III.

TABLE III

| Run | Flammability Retarder | Treating Sequence | QSV | QSH cm./sec. |
|---|---|---|---|---|
| 1 | $Na_4EDTA$ | Single bath | D/C | 0.47 |
| 2 | $Na_4EDTA$ | 1st - Flam. Ret.<br>2nd - Siloxane | E/C | 0.28 |
| 3 | $Na_4EDTA$ | 1st - Siloxane<br>2nd - Flam. Ret. | E/C | 0.52 |
| 4 | $(NH_4)_4EDTA$ | Single Bath | D/C | 0.60 |
| 5 | $(NH_4)_4EDTA$ | 1st - Flam. Ret.<br>2nd - Siloxane | D/C | 0.40 |
| 6 | $(NH_4)_4EDTA$ | 1st - Siloxane<br>2nd - Flam. Ret. | D/C | 0.42 |

EXAMPLE 8

In some instances a material that may be added to the treating bath may have a detrimental effect and prevent the flammability retarder from performing its task. This illustrates the need for the preliminary laboratory evaluation previously referred to. In this example a series of treating baths was prepared and evaluated on polyester fibers. As is seen, Bath III did not retard flammability, possibly due to the fact that the zinc/tin soap was chelated and there was insufficient ethylenediamine tetraacetic acid remaining to act as flame retarder, the fiber was easy to ignite and burned rapidly. In Bath IV, while ignition was rated D, the rate of burning was higher than desired and the fiber was completely burned.

Bath I was an aqueous emulsion containing 0.7 weight percent of the same dimethylpolysiloxane used in Example 1, 0.07 weight percent of ethylenediamine tetraacetic acid and 0.07 weight percent of Surfactant C of Table I.

Bath II was an aqueous emulsion containing 0.7 weight percent of Siloxane III of Table I, 0.07 weight percent of ethylenediamine tetraacetic acid and 0.0175 weight percent of Surfactant D of Table I.

Bath III was an aqueous emulsion containing 0.7 weight percent of a hydroxyl end-terminated dimethylpolysiloxane, 0.18 weight percent of aminopropyltriethoxysilane, 0.0175 weight percent of Surfactant D of Table I, 0.07 weight percent of an emulsion of a zinc octoate/dibutyltin diacetate soap, 0.1 weight percent of acetic acid and 0.07 weight percent of ethylenediamine tetraacetic acid.

Bath IV was an aqueous emulsion containing 0.7 weight percent of Siloxane III of Table I, 0.0175 weight percent of Surfactant D of Table I, 0.07 weight percent of ethylenediamine tetraacetic acid, 0.06 weight percent of ammonia and 0.14 weight percent of chlorendic anhydride.

The formulated baths were applied to polyester staple fibers, such as Fiber Fill, by the procedure described in Example 1 to achieve a dry add-on of one weight percent of the siloxane and 0.1 weight percent of the ethylenediamine tetraacetic acid. The fibers were then treated and evaluated as described in Example 1; the results are set forth in Table IV.

TABLE IV

| Bath | QSV | QSH, cm./sec. |
|---|---|---|
| I | D/SE | 0.54 |
| II | D/SE | 0.28 SE |
| III | E/C | 0.79 |
| IV | D/C | 0.75 |

EXAMPLE 9

Two conventional flame retardants were used in conjunction with the flame retardants of this invention. In each instance a first aqueous bath contained 0.7 weight percent of Siloxane III of Table I, 0.0175 weight percent of Surfactant D of Table I and 0.07 weight percent of ethylenediamine tetraacetic acid (Bath I). The second containing the conventional flame retardant had 7 weight percent of a halogenated phosphorus flame retardant (P-7) in one instance (Bath II) and 3.5 weight percent of another commercially available brominated phosphorus flame retardant (Firemaster F-200) in the second instance (Bath III).

Bath I was applied to the polyester staple first to give a loading of one percent silicone and 0.1 percent of the flammability retarder of this invention. The treated fibers were air dried and then cured for 5 minutes at 160° C. Separate portions were then padded with the other flame retardant solutions, Baths II and III, cured 90 seconds at 200° C., followed by a 10 minute wash at 180° F. in an 0.5 percent sodium carbonate solution. They were then air dried and conditioned, and evaluated for flammability.

Polyester fibers treated with Baths I and II had a QSV of E but were self-extinguishing; they had a QSH of 0.27 cm./sec. and were self-extinguishing.

Polyester fibers treated with Baths I and III had a QSV of D and were self-extinguishing; they had a QSH of 0.26 cm./sec. and were self-extinguishing.

EXAMPLE 10

In this example it was shown that the use of the chelators of this invention act as flame retardants with blends of polyester and cotton. Two formulations were prepared and applied to a 65/35 polyester/cotton broad cloth fabric.

Bath I was an aqueous emulsion containing 1.8 weight percent of Siloxane III of Table I, 0.18 weight percent of ethylenediamine tetraacetic acid and 0.18 weight percent of Surfactant C of Table I. The polyester/cotton fabric was immersed in the bath and squeezed between two rollers to achieve a dry add-on of one weight percent of siloxane and 0.1 weight percent of the flame retarder. Flammability was determined using the limiting Oxygen Index Test of ASTM D-2863. In this test the fabric sample is held vertically and ignited at the top. The oxygen content of the gas stream flowing by the ignited sample is varied and the lowest oxygen level at which the sample will burn is reported. Lower levels indicate higher flammability and a difference of 0.2 percent in oxygen content is considered significant since a reduction of this amount results in a self-extinguishing sample. The fabric treated with Bath I had a Limiting Oxygen Index of 18.6 percent.

Bath II was similar to Bath I but did not contain any ethylenediamine tetraacetic acid. The fabric treated in the same manner with this control formulation had a Limiting Oxygen Index of 18.2 percent.

The results shows the flammability retarding effect of the compositions of this invention.

EXAMPLE 11

A series of treated fibers were evaluated for flammability and lubricity. It was observed that the flammability retarder improved the flame retardancy without deleteriously affect the lubricity of the fiber.

Fiber I was treated with the formulations of Baths I and III as described in Example 9.

Fiber II was treated with the formulation of Run 3A of Table I.

Fiber III was treated with the formulation of Run 3B of Table I.

The flammability and lubricity index were determined. Lubricity was measured by pulling a 4,190 grams sled horizontally across a pad of fibers and measuring the force required to move the sled at constant speed. The sliding force in grams divided by the total sled weight in grams is the lubricity index. For further comparative purposes, the untreated fiber had a lubricity index of 0.36. The results are set forth in Table V.

TABLE V

| Fiber | QSH cm./sec. | Lubricity Index |
|---|---|---|
| I | SE | 0.18 |
| II | 0.38 SE | 0.18 |
| III | 0.54 | 0.18 |

For comparative purposes, formulations were prepared containing Siloxane III of Table I in conjunction with two conventional well known chelators, citric acid and polyethylene polyol (PEG) having an average molecular weight of about 4,375 to determine if they also acted as flammability retarders. They were applied to polyester fibers and evaluated as described in Example 1. In both instances, the chelators did not reduce flammability of the fiber to any significant extent. The results are set forth in Table VI.

TABLE VI

| Run | Chelator | QSV | QSH cm./sec. | Lubricity Index |
|---|---|---|---|---|
| 1 | None | E/C | 0.36 | 0.159 |
| 2 | Citric Acid | E/C | 1.11 | 0.182 |
| 3 | PEG | E | 0.30 | 0.183 |

What is claimed is:

1. In a silicone textile treating composition containing a silicone textile treating agent, the improvement of having present in said composition a flammability retarding amount sufficient to retard flammability of a flammability retarder of the formula:

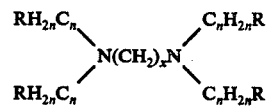

wherein $x$ has a value of from 2 to 4; $n$ has a value of from 1 to 5; R is carboxyl or hydroxyl; or a salt, ether or ester thereof.

2. The improved compositions of claim 1, wherein the amount of flammability retarder present in said composition is from 1 to 25 weight percent, based on the weight of silicone treating agent present.

3. The improved compositions of claim 1, wherein the amount of flammability retarder present in said composition is from 5 to 15 weight percent, based on the weight of silicone treating agent present.

4. The improved compositions of claim 1, wherein the flammability retarder is ethylenediamine tetraacetic acid.

5. The improved compositions of claim 1, wherein the flammability retarder is the disodium salt of ethylenediamine tetraacetic acid.

6. The improved compositions of claim 1, wherein the flammability retarder is the tetrasodium salt of ethylenediamine tetraacetic acid.

7. The improved compositions of claim 1, wherein the flammability retarder is the tetraammonium salt of ethylenediamine tetraacetic acid.

8. The improved compositions of claim 1, wherein the flammability retarder is N,N,N',N'-tetrakis-(2-hydroxypropyl)ethylenediamine.

* * * * *